US005760341A

United States Patent [19]

Laske et al.

[11] Patent Number: 5,760,341

[45] Date of Patent: Jun. 2, 1998

[54] CONDUCTOR CABLE FOR BIOMEDICAL LEAD

[75] Inventors: Timothy G. Laske, Shoreview; David W. Mayer, Bloomington, both of Minn.

[73] Assignee: Medtronic, Inc., Minneapolis, Minn.

[21] Appl. No.: 711,829

[22] Filed: Sep. 10, 1996

[51] Int. Cl.[6] ..... H01B 5/08

[52] U.S. Cl. ..... 174/126.2; 174/128.1; 174/113 R

[58] Field of Search ..... 174/113 R, 113 A, 174/126.2, 128.1, 106 R

[56] References Cited

U.S. PATENT DOCUMENTS

| | | | |
|---|---|---|---|
| 295,086 | 3/1884 | Waring | 174/102 R X |
| 1,691,869 | 11/1928 | Fowle | 474/128.1 |
| 3,366,728 | 1/1968 | Garwin et al. | 174/113 R |
| 3,490,125 | 1/1970 | Frieling, Jr. | 428/592 X |
| 3,572,344 | 3/1971 | Bolduc | 607/129 |
| 3,772,454 | 11/1973 | Donecker et al. | 174/113 R |
| 4,608,986 | 9/1986 | Beranek et al. | 128/786 |
| 4,640,983 | 2/1987 | Comte | 174/119 R |
| 4,860,446 | 8/1989 | Lessar et al. | 29/858 |
| 4,964,414 | 10/1990 | Handa et al. | 128/784 |
| 5,246,014 | 9/1993 | Williams et al. | 607/122 |
| 5,303,704 | 4/1994 | Molacek et al. | 128/642 |
| 5,360,442 | 11/1994 | Dahl et al. | 607/129 |
| 5,483,022 | 1/1996 | Mar | 174/128.1 |

OTHER PUBLICATIONS

Costello, *"Theory of Wire Rope"*, Springer–Verlag 1990, Mechanical Engineering Series, pp. 11–57.

*Primary Examiner*—Kristine L. Kincaid
*Assistant Examiner*—Chau N. Nguyen
*Attorney, Agent, or Firm*—Reed A. Duthler; Harold R. Patton

[57] ABSTRACT

A biomedical lead conductor cable formed of a core wire strand and a plurality of perimeter wire strands wrapped in a helical pattern around the core wire strand, wherein the core wire strand is formed of M wires and the perimeter wire strands are formed of N wires. The core wire strand is formed of a first core wire and M−1 first peripheral wires helically wrapped about the first core wire in a non-overlapping manner, the first core wire having a mechanical strength exceeding the mechanical strength of each first peripheral wire and an electrical conductivity lower than the electrical conductivity of each first peripheral wire. Each perimeter wire strand is formed of a second core wire and N−1 second peripheral wires helically wrapped about the second core wire in a non-overlapping manner, the second core wire conductor having a mechanical strength exceeding the mechanical strength of each second peripheral wire and an electrical conductivity lower than the electrical conductivity of each second peripheral wire. In a preferred embodiment M=N, and the first core wire is formed of a solid metal or metal alloy, whereas first peripheral wires are formed of a composite conductor wire having a core of high conductivity material surrounded by a cladding of lower conductivity material. The second core wire is also preferably formed of a composite conductor wire. The diameters of the first and second core wires exceed the diameters of the first and second peripheral wires, respectively to provide a spacing between adjacent peripheral wires wound helically about the core wires. Moreover, preferably, the diameter of the core wire strand exceeds the diameter of the perimeter wire strands to provide a spacing between the adjacent perimeter wire strands wound about the core wire strand.

14 Claims, 4 Drawing Sheets

CONDUCTOR CABLE FOR BIOMEDICAL LEAD

CROSS-REFERENCE TO RELATED APPLICATIONS

Reference is hereby made to commonly assigned, co-pending U.S. patent application Ser. No. 08/438,125 filed May 8, 1995, in the name of Bret Shoberg et al. for Medical Lead With Compression Lumens.

FIELD OF THE INVENTION

The present invention relates generally to the field of electrical lead conductors, particularly for use in biomedical leads and particularly to multi-strand conductor cables adapted to be used in implantable cardioversion/defibrillation leads.

BACKGROUND OF THE INVENTION

As noted in U.S. Pat. No. 5,483,022, the human body is a hostile environment to implanted medical devices and materials, particularly to implanted cardiac leads which extend into a heart chamber or cardiac vessel or contact the exterior of the heart. The heart beats approximately 100,000 times per day or over 30 million times a year, and each beat stresses at least the distal end portion of the lead. Over the years of implantation, the lead conductors and insulation are subjected to cumulative stresses that can result in degradation of the insulation or fractures of the lead conductors with untoward effects on device performance and patient well being.

Implantable cardiac leads are typically coupled with implanted medical devices, including pacemaker and pacemaker/cardioverter/defibrillator pulse generators and cardiac monitors. Other implanted electrical medical devices using implanted leads include other monitors and electrical stimulators, e.g., spinal cord stimulators.

The implantable cardiac lead conductor typically employed in pacing leads is a single wire, or a multi-filar wire coil used alone in a unipolar lead configuration or used in a pair, coaxially arranged and isolated from one another, in a bipolar lead configuration. The wires of such pacing lead conductors may be formed of a single conductive metal or alloy material, e.g. MP 35N alloy, or of a composite conductive material, typically a silver core wire clad with MP 35N alloy or surgical grade stainless steel or the like in a drawn brazed stranded (DBS) composition fabrication process well known in the art, to provide increased conductivity. Pacing lead conductors are expected to conduct currents of less than 1 mA at voltages less than 10 volts and have a lead resistance of between 40–200 ohms. The principal reason for reducing pacing lead impedance has been for sense amplifier and electrode impedance matching and to decrease pacing pulse current consumption to prolong battery life.

However, the lead conductors employed to deliver cardioversion/defibrillation shocks are subjected to high currents of about 35 amps at 300–800 volts. It is desirable that the cardioversion/defibrillation lead resistance be far lower, on the order of less than 10 ohms. Consequently, the cardioversion/defibrillation lead conductor configurations have a greater cross-section wire gauge and use noble metals to clad the conductor wire(s) or use the DBS type composite lead conductor to a greater extent. The highly conductive noble metals are both expensive and certain of them are relatively weak and subject to fracture under the applied cardiac stresses, and therefore cannot be used as the principal lead conductor material. In addition the non-noble highly conductive metals or metal alloys, including silver, aluminum and copper, cannot be exposed to body fluids since they corrode or migrate when so exposed, further weakening and increasing the resistance of the wire. Despite the best efforts to prevent body fluid intrusion into biomedical leads, the long term exposure in chronic implantation makes it likely that fluid intrusion will eventually occur.

Because of the potential for lead length resistance increase in the coiled configuration, it is much more desirable to provide a straight wire configuration. Moreover, although the coil configuration advantageously defines the stylet wire lumen in endocardial leads, the coil occupies a large amount of cross-section area in the lead body which could be reduced by a straight wire configuration in order to reduce the overall diameter of the lead body. However, the conventional wisdom that has prevailed for many years has dictated that the danger of fracture presented by straight wire lead conductors, particularly in endocardial leads that are subjected to continuous heart motion in the section within a heart chamber, precludes the use of straight wire configurations for both pacing lead bodies and cardioversion/defibrillation lead bodies.

One straight wire configuration used in epicardial pacing leads for several years employed strands of twisted platinum strip wire wrapped around non-conductive cores that are in turn wrapped around a main non-conductive core fiber as disclosed in commonly assigned U.S. Pat. No. 3,572,344.

In U.S. Pat. No. 4,964,414, a biomedical coiled lead conductor cable intended for implantation in the body is disclosed that is formed in seven strands, each strand formed of seven wires, resulting in a "7×7" pattern of 49 total wires. The core wire strand is formed of 7 wires, and the 6 outer or perimeter wire strands are helically wound about the core wire strand to form the 7×7 lead conductor cable. The conductor cable is encased in an outer insulation, and then the encased conductor cable is helically wound into a coil. The adjacent turns of the coil are therefore insulated from one another and a somewhat un-conventional coil configuration of the lead body is obtained.

More recently, straight (i.e., not coiled) 7×7 lead conductor cables of the type shown in the '414 patent and using a DBS composite wire have been introduced by Guidant Corp., St. Paul, Minn. in the Endotak™ defibrillation lead. Straight pacing lead conductor cables have also been introduced using the 7×7 conductor cable configuration as well as the single strand conductor cable configuration as shown, for example, in commonly assigned U.S. Pat. No. 5,246,014.

In the above-referenced '022 patent and in U.S. Pat. No. 4,640,983, a conductor cable is formed of a core wire surrounded by a plurality, e.g. 6, of outer wires that are helically wound in a non-overlapping pattern over the outer surface of the core wire in a "1×7" conductor cable. Then, a number, e.g. three, of these 1×7 lead conductor cables are wound in a multi-filar, common diameter coil to provide an inner lumen for receiving a stiffening stylet in the manner of multi-filar coiled wire pacing lead conductors. In a unipolar embodiment, the three cable coil is enclosed within a single outer insulating sheath. In a bipolar lead embodiment, inner and outer three cable coils are co-axially arranged and separated from one another by an inner insulating sheath.

In order to form the small diameter coil, the conductor cables must be wound about a mandrel, and the winding stress can deform the wires forming the cable particularly the higher conductivity and weaker composite wires. Without discussing this consideration, it is suggested in the '983 patent that the wire compositions be either all the same or different, mixing wires formed of more conductive but less strong metal or metal alloy with wires formed of stronger, but higher resistance, metals or metal alloys. Since the core wire is shorter than the outer wires, it is suggested that it may preferably be formed of the weaker, more conductive material, e.g. silver or copper. The possibility of corrosion of the copper (or silver if used instead) by fluid leakage into the lumen of the outer insulating sheath is not addressed. Separately from the material selection, it is suggested that the core wire be of a greater diameter than the outer wires or that the core wire be itself formed of a cable constructed in the same manner as described.

In the '022 patent, it is explicitly suggested that all of the wires be formed of a composite material, particularly a drawn filled tubing (DFT) MP 35N-silver composite fabrication of the conductor of the same composition. In this case, all of the seven core and outer wires are formed of the DFT composite material apparently in order to increase current carrying capacity. However, the silver concentration of the composite would have to be quite low in order to wind such composite wires first into a cable as described therein and then into the described coil configuration in order to withstand the coil winding stress.

Moreover, neither patent addresses the imbalances in applied bending stresses that are encountered in the three cable helical coil configurations disclosed therein or the selection of wire materials to address those imbalances.

None of these patents address the considerations of material selection or wire size selections for straight lead conductor cables for use in implantable pacing and cardioversion/defibrillation leads. One reason for coiling the conductor cables and using plural coiled conductor cables in the multi-filar arrangement as shown in the '022 and '983 patents is to gain the assurance that the coils will be less subject to fracture or breakage gained through years of use of solid wire (as opposed to the disclosed conductor cable), multi-filar lead conductors. However, by coiling the wire/cable of any such configuration, the overall wire/cable length is increased enormously over the lead body length. In order to reduce overall resistance of the wire/cable, it is emphasized that the adjacent coil turns contact one another intimately in the '022 and '983 patents, which follows from the prevailing practice with solid wire multi-filar coil fabrication. Such a tight winding can stress the outer wires of the conductor cables.

Despite these improvements, a need remains for a medical lead employing a conductor cable configuration with improved survival in chronic implantation over the long term and providing suitable current carrying capacity for conducting cardioversion/defibrillation energy.

SUMMARY OF THE INVENTION

Accordingly, it is an object of the present invention to enhance the strength and electrical current carrying capacity of biomedical leads formed of a plurality of conductor cables, particularly for straight lead conductor applications.

These and other objects of the present invention are realized in a biomedical lead conductor cable formed of a core wire strand and a plurality of outer or perimeter wire strands wrapped in a helical pattern around the core wire strand, wherein the core wire strand is formed of M wires of a first combined strength and conductivity and the perimeter wire strands are formed of N wires of a second combined strength having a resistance to strain that is lower than the first strength and a second combined conductivity that is higher than the first conductivity.

More particularly, the core wire strand is formed of a first core wire and M−1 first peripheral wires helically wrapped about the first core wire in a non-overlapping manner, the first core wire and the first peripheral wires formed to provide the first core wire with a mechanical strength (tensile strength) exceeding the mechanical strength of each first peripheral wire and an electrical conductivity lower than the electrical conductivity of the first peripheral wire; and each perimeter wire strand is formed of a second core wire and N−1 second peripheral wires helically wrapped about the second core wire in a non-overlapping manner, the second core wire and the second peripheral wires formed to provide the second core wire with a mechanical strength exceeding the mechanical strength of each second peripheral wire and an electrical conductivity lower than the electrical conductivity of the second peripheral wires.

In a preferred embodiment M=N, and the first core wire is formed of a solid metal or metal alloy, whereas the first peripheral wires are formed of a composite conductor wire having a core of high conductivity material surrounded by a cladding of lower conductivity material. The second core wire is also preferably formed of a composite conductor wire.

In a further preferred embodiment, the diameters of the first and second core wires exceed the diameters of the first and second peripheral wires, respectively to provide a spacing between adjacent peripheral wires wound helically about the core wires in each of the wire strands. Moreover, preferably, the diameter of the core wire strand exceeds the diameter of the perimeter wire strands to provide a spacing between the adjacent perimeter wire strands wound about the core wire strand.

Advantageously, the combination of materials for the core wires and peripheral wires of each wire strand provides a strong lead conductor cable with enhanced electrical conductivity particularly for use in straight biomedical lead conductors in unipolar and multi-polar lead configurations. The relative sizing of the diameters of the core wires and core wire strands vis-à-vis the peripheral wires and the perimeter wire strands, respectively, further enhances the strength of the lead conductor.

BRIEF DESCRIPTION OF THE DRAWINGS

Other objects, advantages and features of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

The lead conductor cable of the present invention is preferably embodied in the construction of an implantable cardioversion/defibrillation lead for conducting cardioversion/defibrillation shocks from an implantable cardioverter/defibrillator or pacemaker/cardioverter/defibrillator to a distal electrode and to the patient's heart in direct or indirect contact therewith. However, the lead conductor cable of the invention may also advantageously be used in a pacing lead or other medical lead intended for chronic implantation. The lead conductor cable is disposed within a sheath lumen, and the lead may be configured with one or a plurality of such lead conductor cables and respective lumens.

Figure 1:
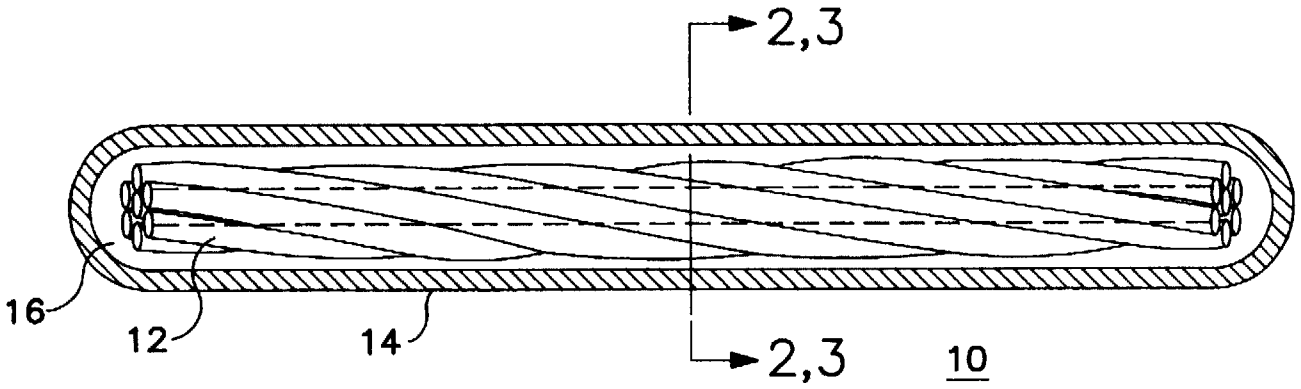
FIG. 1 is a schematic illustration in partial cross-section of a straight lead cable conductor in accordance with a first embodiment of the present invention.

Turning to FIG. 1, a section of a biomedical lead 10 is depicted comprising an M×N conductor cable 12 surrounded by an insulating sheath 14 for insulating the conductor cable 12 and isolating it from body fluids and tissues. The sheath 14 may be formed of a medical grade silicone rubber or polyurethane well known in the art. In this particular lead configuration, the conductor cable 12 is extended relatively straight within a lumen 16 of sheath 14 which, in fact, may contain additional lumens for additional conductor cables 12 of the same type or including lead conductors of different types and providing a stylet lumen in the manner shown in commonly assigned U.S. Pat. No. 5,303,704, incorporated herein by reference in its entirety, or in the above-referenced '125 application.

It will be understood that each proximal end of each such conductor cable 12 incorporated into a lumen 16 of a lead 10 is coupled with a connector element at the proximal lead connector end for making electrical connection with a terminal of an implanted medical device, e.g. an ICD (implantable cardioverter/defibrillator) or PCD (Pacemaker/Cardioverter/Defibrillator) in the case of a cardioversion/defibrillation lead 10. The distal ends of each conductor cable 12 is connected to an electrode or sensor or the like.

Figure 2:
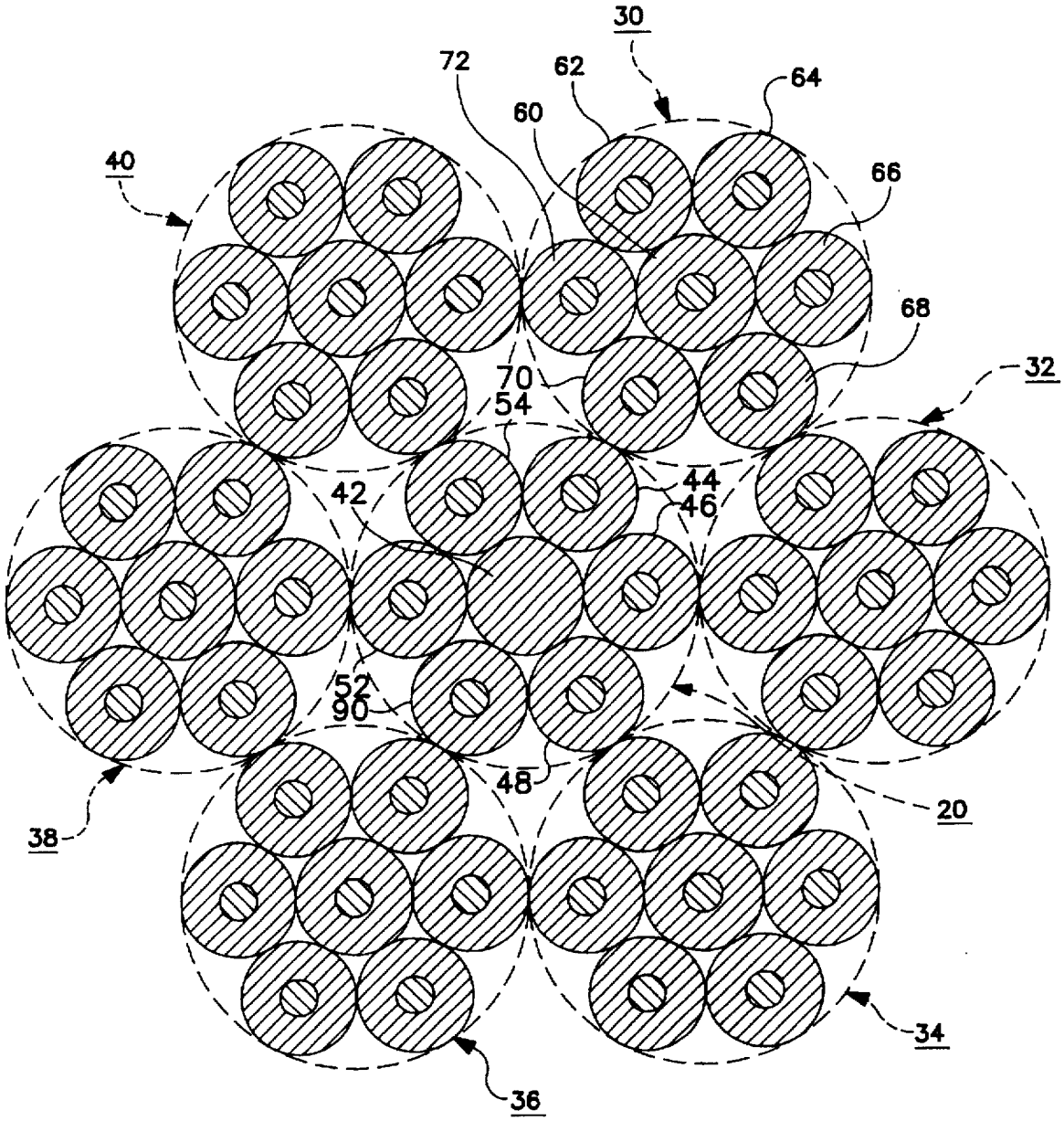
FIG. 2 is an idealized cross-section view of the catheter body taken along lines 2—2 of FIG. 1 showing a first embodiment of the invention.

Turning to the idealized cross-section view of FIG. 2, it depicts a 7×7 conductor cable 12. In this embodiment, a core wire strand 20 is formed of seven wires and is preferably surrounded by a plurality, e.g. N−1=6 in the depicted embodiment, of perimeter wire strands 30, 32, 34, 36, 38, 40 helically wound about the core wire strand 20 without overlapping one another and at a relatively constant and shallow pitch to form a relatively constant conductor cable diameter D. The core wire strand 20 is formed of M=N, where N=7 in the depicted embodiment, wires including first core wire 42 and N−1 first peripheral wires 44, 46, 48, 50, 52 and 54 helically wound about first core wire 42 without overlapping one another and at a relatively constant wire pitch in a relatively constant diameter DC. The core wire strand 20 can be referred to as a 1×N cable, i.e., a 1×7 cable in this embodiment.

Each of the N−1 perimeter wire strands is similarly formed of N or 7 wire filaments or strands including a second core wire and N−1 or 6 second peripheral wires helically wound about the second core wire without overlapping one another at a relatively constant wire pitch to form 1×7 cable with a relatively constant perimeter wire strand diameter DP. Only the second core wire 60 and the second peripheral wires 62, 64, 66, 68, 70, and 72 of perimeter wire strand 30 are shown in detail, and it will be understood that the other 5 perimeter wire strands are formed in the same manner. The conductor cable of FIGS. 1 and 2 therefore follows the N×N or 7×7 conductor cable configuration.

The core wire strand 20 is relatively straight and subjected to a greater stress and strain on bending than the helically wrapped perimeter wire strands 30, 32, 34, 36, 38, 40. In a first aspect of the invention, the core wire strand 20 is constructed differently than the helically wrapped perimeter wire strands 30, 32, 34, 36, 38, 40, in order to better withstand these higher stresses and strains. In this embodiment, the core wire 42 is formed of a single, high strength conductor material, preferably MP 35N alloy, having a first electrical conductivity (CCWS) Conductive of the Core Wire Strands per unit area. The first peripheral wires 44, 46, 48, 50, 54 of core wire strand 20 may be preferably formed of a composite material having a greater electrical conductivity (CPWS) Conductive of the Peripheral Wire Strands per unit area, e.g. DBS MP 35alloy with a first silver or gold content. The helically wrapped, perimeter wire strands 30, 32, 34, 36, 38, 40 may be formed of materials wherein, for example, the second core wire conductivity CCWS' per unit area is preferably less than the peripheral wire conductivity per unit area CPWS'. The conductivities are related to one another in the following manner:

$$CCWS<CPWS\leqq CCWS'<CPWS'$$

For example, the first peripheral wires 44, 46, 48, 50, 52, 54 and the second core wire 60 may both be formed of DBS or DFT wire of 75% MP 35N cladding and 25% silver or gold core, by volume. The second peripheral wires 62, 64, 66, 68, 70, 72 may be formed of DBS or DFT wire of 59% MP 35N cladding and 41% silver or gold core, by volume.

Figure 3:
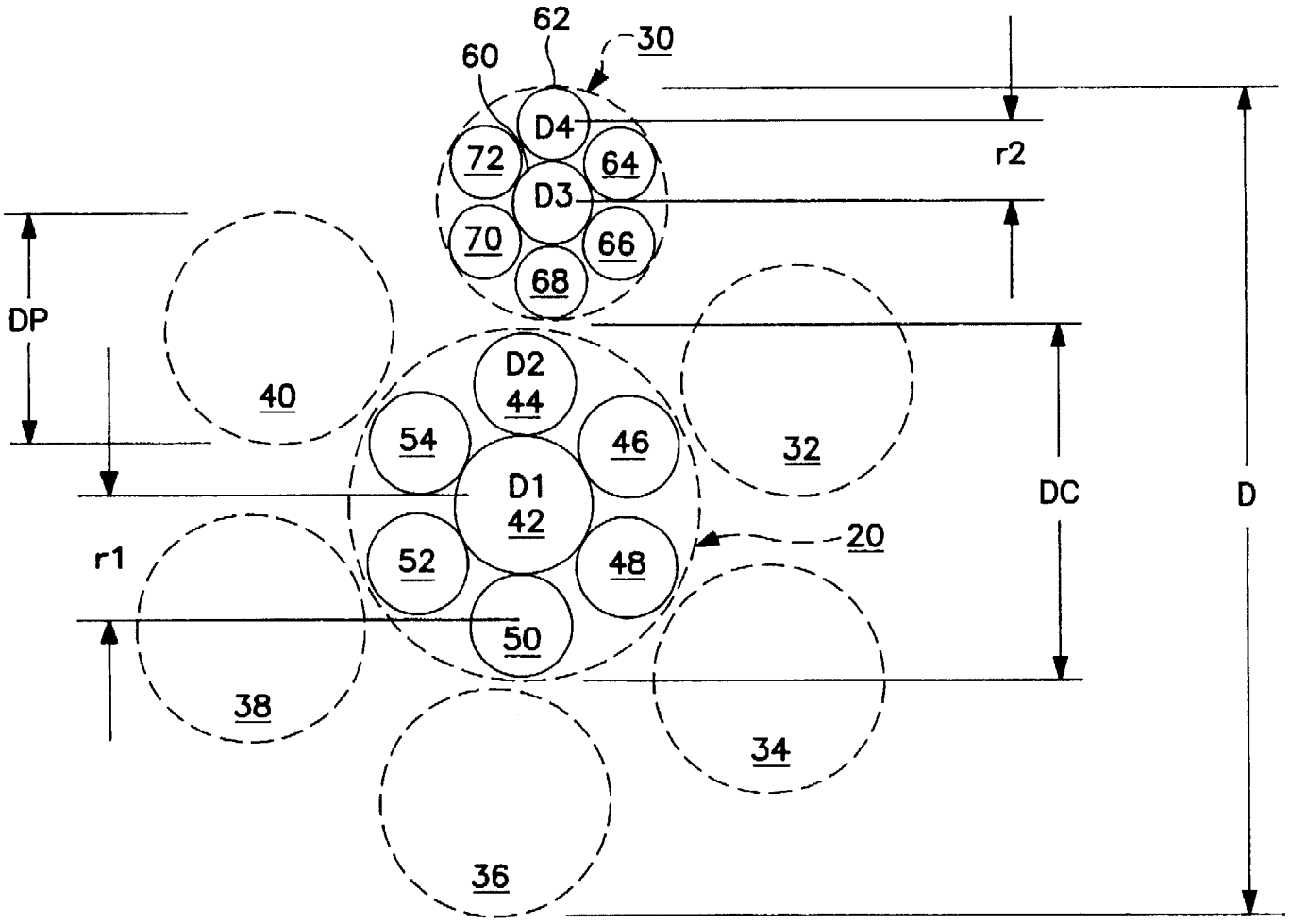
FIG. 3 is an idealized cross-section view of the catheter body taken along lines 3—3 of FIG. 1 showing a second embodiment of the invention.

In a second aspect of the invention depicted in FIG. 3, the diameter DC of the core wire strand 20 is preferably greater than the diameter DP of the perimeter wire strands 30, 32, 34, 36, 38, 40. This allows the perimeter wire strands 30, 32, 34, 36, 38, 40 to be spaced apart from one another and not make contact with one another. This spacing is not disclosed in the above referenced patents, but is preferred to be incorporated into biomedical lead conductors of this type in accordance with this aspect of the invention in order to increase the capability of the perimeter wire strands 30, 32, 34, 36, 38, 40 to bend with respect to the core wire strand 20. In addition, the spacing maintains electrical contact of the peripheral wires with the core wires in each of the perimeter wire strands 30, 32, 34, 36, 38, 40 and between the peripheral wires of the perimeter wire strands 30, 32, 34, 36, 38, 40 and the peripheral wires 44, 46, 48, 50, 52, 54 of the core wire strand 20. As described in *Theory of Wire Rope*, by George A. Costello, Springer-Verlag, New York (1990), the lack of any spacing between the outer wires of a 1×7 strand results in loss of line contact between the core wire and the peripheral wires (see section 3.11), and this principle applies to a cable formed of a core wire strand and 6 perimeter wire strands of the same diameter.

In the inner strand (e.g. strand 20), the core wire 42 is subjected to the greatest stress and strain. The diameter D1 of the inner or first core wire 42 is preferably greater than the diameters, e.g. D2, of the peripheral wires 44, 46, 48, 50, 52, 54 wound helically about it. Similarly, in the second or perimeter wire strands 60, 62, 64, 66, 68, 70, the second core wire diameter, e.g. diameter D3 of core wire 60, is preferably greater than the diameter D4 of the second peripheral wires, e.g. diameter D4 of second peripheral wires 62, 64, 66, 68, 70, 72. The second core wire diameter D3 may be greater or equal to or less than the first peripheral wire diameter D2. The preferred diameters are related to one another in the following manner:

$$D>DC>DP>D1>D3\geqq D2>D4$$

Figure 4:
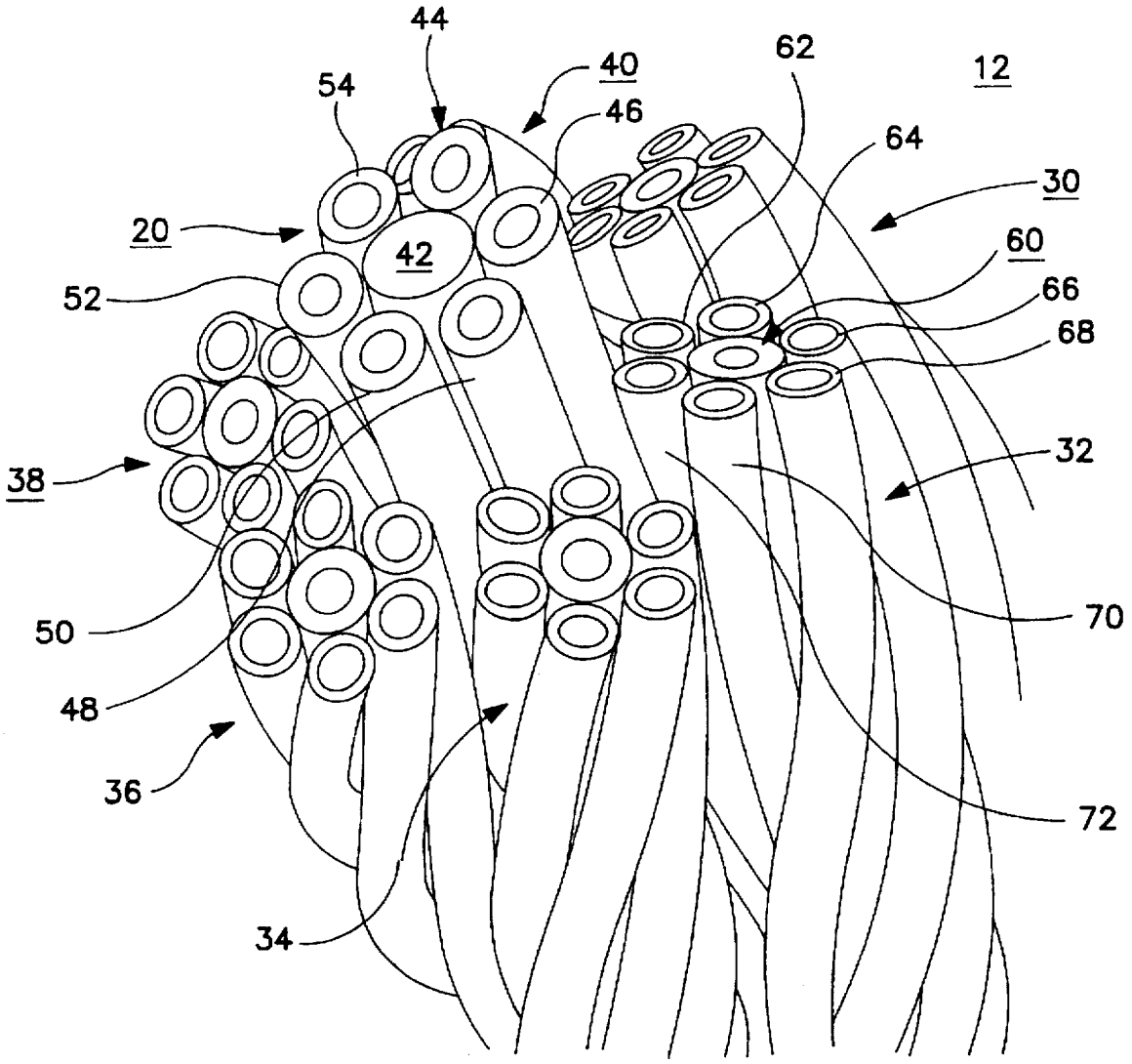
FIG. 4 is a perspective end view of the second preferred embodiment of the straight lead cable conductor of the present invention depicted in FIG. 3.

For example, the diameters of a preferred embodiment are as follows:

D=0.127 inches
DC=0.049 inches
DP=0.039 inches
D1=0.0019 inches
D2/D3=0.0015 inches
D4=0.0012 inches FIG. 4 depicts a perspective end view of the 7×7 conductor cable of the present invention showing both the relative wire, strand and conductor cable diameters in the relationship described above and the above-described compositions for the 49 wires identified above, and the spacing apart and pitch of the peripheral wires of each strand.

It will be understood that other permutations and combinations of wire diameter of FIG. 3 and composition of FIG. 2 may be made in an M×N lead conductor cable following the general proposition of making the core wire strand 20 of a size and material composition that strengthens it relative to the perimeter wire strands while sacrificing its conductivity to the extent necessary with respect to the perimeter wire strands. For example, the first core wire 42 may be a non-conductive material, e.g. a high strength polymer. Moreover in such an example, then the first peripheral wires may be formed of the above-described MP 35N-silver alloy in any suitable silver concentration or may be formed of MP 35N alloy alone.

Additionally, the conductivity of the second core wires, e.g. second core wire 60, may be the same as the conductivity of the first core wire 42, leaving only the conductivities of the second peripheral wires higher than that of the remaining wires.

Alternatively, although the first core wire 20 is depicted without any silver content for improving conductivity, it will be understood that it may also be formed of a DBS or DFT conductor with a minor concentration of silver.

The disparity in conductivities described above may be effected in any manner, including coating of the individual wires with a highly conductive noble metal, e.g. gold or platinum, or by the use of alloys of such noble metals in varying concentrations providing varying conductivity. In addition, while the disclosed embodiment employs solid wires and wires formed of two different materials, wires having three or more layers of different materials may also be employed to provide the various strengths and conductivities desired in a lead according to the present invention.

In addition, although the preferred embodiment is described in relation to an M×N lead conductor cable where M and N equal seven, it will be understood that the invention is applicable to other more complicated cable configurations that are possible as the perimeter wire strand diameter DP is diminished with respect to the core wire strand diameter DC. As the diameter DP of the perimeter wire strands is diminished further than depicted in FIG. 3, it becomes possible to wind a greater number N−1 of perimeter wire strands about the core wire strand 20 than the depicted six perimeter strands. However, the diameters D3 and D4 must also be diminished to accomplish this. The conductivities of the perimeter wire strands may have to be further increased to provide current carrying capacity for the smaller diameter wires of the perimeter strands.

While the present invention has primary utility in straight lead conductors for use in conducting cardioversion/defibrillation shock energy, it will be understood that it may be used in any type of biomedical lead to increase electrical current carrying capacity and to provide high reliability and strength in withstanding the stress induced by the motion of the beating heart and by patient movement.

While there has been shown what are considered to be the preferred embodiments of the invention, it will be manifest that many changes and modifications may be made therein without departing from the essential spirit of the invention. It is intended, therefore, in the following claims to cover all such changes and modifications as may fall within the true scope of the invention.

We claim:

1. A biomedical lead conductor cable formed of a core wire strand and a plurality of perimeter wire strands wrapped in a helical pattern around the core wire strand, wherein the core wire strand is formed of M wires and the perimeter wire strands are each formed of N wires and wherein:

the core wire strand is formed of a first core wire and M−1 first peripheral wires helically wrapped about the first core wire in a non-overlapping manner, the first core wire and each of the first peripheral wires formed to provide the first core wire with a mechanical strength exceeding the mechanical strength of each of the first peripheral wires and an electrical conductivity lower than the electrical conductivity of each of the first peripheral wires; and each of the perimeter wire strands is formed of a second core wire and N−1 second peripheral wires helically wrapped about each of the second core wires in a non-overlapping manner, each of the second core wires and each of the second peripheral wires formed to provide each of the second core wires with a mechanical strength exceeding the mechanical strength of each of the second peripheral wires and an electrical conductivity lower than the electrical conductivity of each of the second peripheral wires.

2. The biomedical lead conductor cable of claim 1 wherein M=N.

3. The biomedical lead conductor cable of claim 2 wherein the first core wire is formed of a solid metal or metal alloy, whereas each of the first peripheral wires is formed of a composite conductor wire having a core of high conductivity material surrounded by a cladding of lower conductivity material.

4. The biomedical lead conductor cable of claim 3 wherein each of the second core wires is also formed of a composite conductor wire having a core of high conductivity metal surrounded by a cladding of lower conductivity material.

5. The biomedical lead conductor cable of claim 4 wherein the diameters of the first and second core wires exceed the diameters of the first and second peripheral wires, respectively to provide a spacing between adjacent peripheral wires wound helically about the core wires.

6. The biomedical lead conductor cable of claim 5 wherein the diameter of the core wire strand exceeds the diameter of the perimeter wire strands to provide a spacing between the adjacent perimeter wire strands wound about the core wire strand.

7. The biomedical lead conductor cable of claim 2 wherein the diameters of the first and second core wires exceed the diameters of the first and second peripheral wires, respectively to provide a spacing between adjacent peripheral wires wound helically about the core wires.

8. The biomedical lead conductor cable of claim 7 wherein the diameter of the core wire strand exceeds the diameter of the perimeter wire strands to provide a spacing between the adjacent perimeter wire strands wound about the core wire strand.

9. The biomedical lead conductor cable of claim 1 wherein the first core wire is formed of a solid metal or metal alloy, whereas first peripheral wires are formed of a composite conductor wire having a core of high conductivity material surrounded by a cladding of lower conductivity material.

10. The biomedical lead conductor cable of claim 9 wherein the second core wire is also preferably formed of said composite conductor wire.

11. The biomedical lead conductor cable of claim 10 wherein the diameters of the first and second core wires exceed the diameters of the first and second peripheral wires, respectively to provide a spacing between adjacent peripheral wires wound helically about the core wires.

12.. The biomedical lead conductor cable of claim 11 wherein the diameter of the core wire strand exceeds the diameter of the perimeter wire strands to provide a spacing between the adjacent perimeter wire strands wound about the core wire strand.

13. The biomedical lead conductor cable of claim 1 wherein the diameters of the first and second core wires exceed the diameters of the first and second peripheral wires, respectively to provide a spacing between adjacent peripheral wires wound helically about the core wires.

14. The biomedical lead conductor cable of claim 13 wherein the diameter of the core wire strand exceeds the diameter of the perimeter wire strands to provide a spacing between the adjacent perimeter wire strands wound about the core wire strand.

* * * * *